US005634454A

United States Patent [19]

Fujita

[11] Patent Number: 5,634,454

[45] Date of Patent: Jun. 3, 1997

[54] FAILURE DETECTING DEVICE FOR A FUEL SUPPLY SYSTEM OF AN INTERNAL COMBUSTION ENGINE

[75] Inventor: Tomohiro Fujita, Toyota, Japan

[73] Assignee: Toyota Jidosha Kabushiki Kaisha, Aichi, Japan

[21] Appl. No.: 614,217

[22] Filed: Mar. 12, 1996

[30] Foreign Application Priority Data

Mar. 14, 1995 [JP] Japan ..... 7-054485

[51] Int. Cl.[6] ..... F02D 41/14; F02D 41/22

[52] U.S. Cl. ..... 123/690; 123/698

[58] Field of Search ..... 123/479, 520, 123/690, 698

[56] References Cited

U.S. PATENT DOCUMENTS 5,070,847 12/1991 Akiyama et al. ..... 123/690 X
5,559,706 9/1996 Fujita ..... 123/690 X

FOREIGN PATENT DOCUMENTS 4-318251 11/1992 Japan .
5-163983 6/1993 Japan .

*Primary Examiner*—Tony M. Argenbright
*Attorney, Agent, or Firm*—Kenyon & Kenyon

[57] ABSTRACT

In the present invention, the fuel injection amount of the engine is determined by an air-fuel ratio feedback correction factor FAF and a feedback learning correction factor KG and a fuel vapor learning correction factor FGPG. When the fuel vapor is supplied to the engine, the value of FGPG is adjusted so that the center value of the fluctuation of FAF agrees with 1.0 while the value of KG is held at the value before the fuel vapor supply started. On the other hand, when the fuel vapor is not supplied to the engine, the value of KG is adjusted so that the center value of the fluctuation of FAF agrees with 1.0 while the value of FGPG is set at 0. Therefore, the value (FAF+KG) indicates whether a failure has occurred in the fuel supply system regardless of the fuel vapor supply to the engine. Further, if the value (FAF+KG) becomes larger than or smaller than a predetermined range when the fuel vapor is supplied to the engine, i.e., if it is determined that the fuel supply system has failed when the fuel vapor is supplied to the engine, the fuel vapor supply is stopped, and determination whether the value (FAF+KG) is larger than or smaller than a predetermined range, is carried out again after the fuel vapor supply has been stopped. Therefore, an error in failure detection can be eliminated.

3 Claims, 9 Drawing Sheets

FAILURE DETECTING DEVICE FOR A FUEL SUPPLY SYSTEM OF AN INTERNAL COMBUSTION ENGINE

BACKGROUND OF THE INVENTION

1. Field of the Invention

The present invention relates to a method and a device for detecting failure in a fuel supply system of an internal combustion.

2. Description of the Related Art

A failure detecting device which is capable of detecting failure of elements in a fuel supply system of an internal combustion engine such as an air-flow meter and a fuel injection valve based on an output signal of an air-fuel ratio sensor disposed in an exhaust gas is commonly used. A failure detecting device of this type is disclosed in, for example, Japanese Unexamined Patent Publication (Kokai) No. 5-163983. The device in the '983 publication sets the amount of fuel TAU which is supplied to the engine based on an air-fuel ratio feedback correction factor FAF and a feedback learning correction factor FGHAC using the following formula.

$$TAU=TP\times(FAF+FGHAC)\times T_1+T_2 \quad (1)$$

TP in the above formula is a basic fuel supply amount which is required to maintain an operation air-fuel ratio of the engine at a stoichiometric air-fuel ratio, an $T_1$ and $T_2$ are predetermined constants determined by the operating conditions of the engine. The air-fuel ratio feedback correction factor FAF is calculated in accordance with the output signal of the air-fuel ratio sensor in such a manner that FAF is increased when the air-fuel ratio of the exhaust gas is higher than the stoichiometric air-fuel ratio (i.e., when the air-fuel ratio of the exhaust gas is lean) and decreased when the air-fuel ratio of the exhaust gas is lower than the stoichiometric air-fuel ratio (i.e., when the air-fuel ratio of the exhaust gas is rich). The feedback learning correction factor FGHAC is a correction factor which is determined by a learning control which will be explained later in detail in such a manner that the center value of the fluctuation of the air-fuel ratio feedback correction factor FAF agrees with a reference value (for example, 1.0).

When the characteristics of the elements in the fuel supply system such as an airflow meter and a fuel injection valve agree with design characteristics, i.e., when there is no change in the characteristics due to a lapse of time, or inherent individual deviations of the characteristics, the value of the air-fuel ratio feedback correction factor FAF always fluctuates around a center value of 1.0 when the air-fuel ratio of the engine is feedback controlled in accordance with the output of the air-fuel ratio sensor. In this case, since the value of the feedback learning correction factor FGHAC is changed so that the center value of the fluctuation of FAF agrees with the reference value 1.0, the value of FGHAC always becomes 0. Namely, if the characteristics of the elements in the fuel supply system do not deviate from the design characteristics, the value of the feedback learning correction factor FGHAC always becomes 0. Therefore, the value of the term (FAF+FGHAC) in the above formula (1) also fluctuate around the center value 1.0.

However, if one of the characteristics of the elements in the fuel supply system deviates from the design characteristics due to, for example, a lapse of time, the center value of the fluctuation of FAF also deviates from the reference value of 1.0. For example, if the amount of fuel supplied to the engine becomes larger than a designed value due to a change in the characteristics of an element in the fuel supply system, the air-fuel ratio of the exhaust gas becomes rich, and the air-fuel ratio sensor outputs a rich air-fuel ratio signal. First, this causes a decrease in air-fuel ratio feedback correction factor FAF and, thereby causes FAF to fluctuate around a center value less than 1.0 to reduce the amount of fuel supplied to engine. Assuming that the value of FAF starts to fluctuate around the center value (1.0–α), since the value of the feedback learning correction factor FGHAC is maintained at 0 at the start of the deviation of the characteristics of the element, the value of the term (FAF+FGHAC) in the above formula (1) also fluctuates around the center value (1.0–α). However, since the value of FGHAC is adjusted by a learning control in such a manner that the center value of the fluctuation of FAF agrees to 1.0, the value of FGHAC gradually decreases to a value which makes the center value of the fluctuation of FAF agree with 1.0 (i.e., the value of FGHAC decreases to –α from 0 after a certain time has elapsed). Thus, the center value of the fluctuation of FAF returns to 1.0 while maintaining the center value of the fluctuation of (FAF+FGHAC) at (1.0–α) after a certain time has elapsed since the characteristics of the element deviated from the design characteristics. Therefore, the fuel supply amount is reduced to correct the deviation of the characteristics of the element while maintaining the center value of the fluctuation of FAF at the reference value 1.0.

Similarly, if the amount of fuel supplied to the engine becomes smaller than the designed value due to change in the characteristics of the element in the fuel supply system, the value of FGHAC increases to increase the fuel supply amount while maintaining the center value of the fluctuation of FAF at the reference value 1.0. Namely, the value of the feedback learning correction factor FGHAC changes in accordance with the change in the characteristics of the elements in the fuel supply system. By this learning control using the factor FGHAC, the air-fuel ratio of the exhaust gas (i.e., the operating air-fuel ratio of the engine) is maintained at the stoichiometric air-fuel ratio while maintaining the center value of the fluctuation of FAF at the reference value even when the characteristics of the elements in the fuel supply system deviate from the design characteristics.

As explained above, in the '983 publication, two types of correction factors, i.e., an air-fuel ratio feedback correction factor FAF and a feedback learning correction factor FGHAC are used to control the air-fuel ratio of the engine. The air-fuel ratio feedback correction factor FAF is used for correcting a temporary change in the air-fuel ratio caused, for example, by the change in the operating conditions of the engine, and the value of FAF changes quickly in accordance with the change in the air-fuel ratio. The feedback learning correction factor FGHAC is used for correcting a permanent change in the air-fuel ratio caused, for example, by the change in the characteristics of the elements in the fuel supply system, and the value of FAF changes gradually in accordance with the change in the value of FAF. As a result, the value (FAF+FGHAC) always indicates whether failure has occurred in the fuel supply system. For example, when a fuel injection valve of the engine fails and the amount of fuel injection suddenly increases, the value of FAF largely decreases in a short time to reduce the fuel injection amount. This causes the value (FAF+FGHAC) to decrease in a short time after the fuel injection valve has failed. Then, the value of FGHAC decrease gradually, and the value of FAF gradually increases until it returns to the reference value 1.0. However, even during the changes in the values of FAF and FGHAC, the center value of the fluctuation of (FAF+

FGHAC) is maintained at a constant value much smaller than 1.0 in this case. Similarly, if the fuel supply amount suddenly decreases due to failure in the fuel supply system, the center value of the fluctuation of (FAF+FGHAC) becomes a value much larger than 1.0 from the instant when the failure occurs. Therefore, it is considered that failure occurs in the fuel supply system if the value of (FAF+FGHAC) fluctuates beyond the range of the fluctuation normally caused by the deviations of the characteristics of elements.

However, in the engine equipped with an evaporative emission control device in which the fuel vapor from a fuel tank is supplied to an intake air passage of the engine to prevent evaporative emission, a problem arises if the failure in the fuel supply system is detected based on the value of (FAF+FGHAC). In this engine, the fuel vapor from the fuel supply system is supplied to the engine in addition to the fuel injected from the fuel injection valves. Therefore, since a total amount of fuel supplied to the engine is increased when the fuel vapor is supplied to the engine, the value of (FAF+FGHAC) becomes a smaller value compared to the value when the fuel vapor is not supplied to the engine even if failure does not occur in the fuel supply system, and if failure is detected based on the value of (FAF+FGHAC), error in the failure detection may occur.

In the '983 publication, this problem is solved by the following method. Namely, the failure detecting device in the '983 publication, determines that failure occurs in the fuel supply system when the value of (FAF+FGHAC) becomes smaller than a predetermined lower limit value. However, when the fuel vapor is supplied to the engine, the device in the '983 publication does not determine the failure immediately even if the value (FAF+FGHAC) becomes smaller than the lower limit value. In this case, the device stops the fuel vapor supply to the engine and sets the value of the feedback learning correction factor FGHAC to 0, and after a predetermined time has elapsed, determines whether the value of (FAF+FGHAC) is lower than a predetermined lower limit. The device determines that the fuel supply system has failed only when the value of (FAF+FGHAC) is still lower than the lower limit when the predetermined time has elapsed after the fuel vapor supply has been stopped. If there is no failure in the fuel supply system, the center value of the fluctuation of (FAF+FGHAC) gradually converges to the original value corresponding to the deviation of the characteristics of the elements in the fuel supply system after the fuel vapor supply to the engine has been stopped. Therefore, by determining failure in the fuel supply system in this condition, an error in the failure detection due to the fuel vapor supply is eliminated.

However, further problems may arise in the failure detecting device of the '983 publication. Namely, in the '983 publication, the center value of the fluctuation of FAF is adjusted by a learning control using only the feedback learning correction factor FGHAC regardless of whether the fuel vapor is supplied to the engine. As explained before, the feedback learning correction factor FGHAC was originally intended to compensate for the change in the characteristics of the elements in the fuel supply system and the value of FGHAC changes at relatively low speed. However, in the '983 publication, the same feedback learning correction factor FGHAC is used for compensating for the fuel vapor supplied to the engine, in addition to the change in the characteristics of the elements. In the '983 publication, when the fuel vapor supply to the engine is started or stopped, the center value of the fluctuation of FAF deviates largely from the reference value 1.0 since the amount of fuel supplied to the engine changes in accordance with start and stop of the fuel vapor supply. This deviation of the center value of FAF is corrected by the change in the value of FGHAC. However, since the changing speed of the value of FGHAC is relatively slow, it takes a relatively long time before the center value of FAF converges to 1.0. Therefore, in the '983 publication, every time when the fuel vapor supply is started or stopped, the center value of FAF deviates from 1.0 for a relatively long time. Further, in the '983 publication, the value of FGHAC is reset to 0 every time when the fuel vapor supply is stopped to perform the failure detection. This causes the center value of FAF to deviate, by a large amount, from 1.0 every time the failure detection is carried out. As explained later, when the center value of FAF deviates from the reference value 1.0, the controllable range of the air-fuel ratio of the engine becomes narrow. Therefore, in the '983 publication, when the failure detection is carried out, the controllable range of air-fuel ratio of the engine becomes narrow for a relatively long time.

Further, according to the device in the '983 publication, it is difficult to correctly detect the failure of fuel supply system in which the fuel supply amount to the engine decreases. For example, if the fuel injection amount of the fuel injection valve decreases due to, for example, blockage of injection nozzle by carbon deposit, the value (FAF+FGHAC) increases by a large amount to compensate for the decrease in the fuel injection amount. However, if this failure occurs when the fuel vapor is supplied to the engine, the amount of increase in the value (FAF+FGHAC) becomes smaller since the fuel vapor is supplied to the engine. In this case, the value (FAF+FGHAC) may stay lower than the upper limit value. In the '983 publication, when the value (FAF+FGHAC) is lower than the upper limit value during the fuel vapor supply, it is determined that the fuel supply system is normal even if the system has actually failed. In fact, the device in the '983 publication is directed only to the detection of the failure of the fuel supply system in which the fuel supply amount to the engine increases (i.e., the failure in which the value (FAF+FGHAC) becomes lower than the lower limit) in order to prevent the error in the failure detection.

SUMMARY OF THE INVENTION

In view of the problems set forth above, the object of the present invention is to provide a method and a device for detecting a failure in the fuel supply system which is capable of correctly detecting a failure in the fuel system of the engine equipped with an evaporative emission control device.

Further, another object of the present invention is to provide a method and a device which does not cause the center value of the fluctuation of the air-fuel ratio feedback correction factor to deviate from the reference value when performing the failure detection during fuel vapor supply.

The above-mentioned object is achieved by a failure detecting device for a fuel supply system of an internal combustion engine according to the present invention, in which the failure detecting device comprises fuel vapor supply means for supplying and stopping the fuel vapor from a fuel supply system to an intake air passage of an engine, an air-fuel ratio sensor disposed in an exhaust gas passage of the engine for detecting the air-fuel ratio of an exhaust gas from the engine, feedback control means for setting a value of an air-fuel ratio feedback correction factor in accordance with the air-fuel ratio of the exhaust gas detected by the air-fuel ratio sensor in such a manner that the air-fuel ratio of the exhaust gas becomes a stoichiometric air-fuel ratio, feedback learning correction means for setting a value of a feedback learning correction factor when the fuel vapor is not supplied to the intake air passage in such a manner that the center value of the fluctuation of the air-fuel ratio feedback correction factor agrees with a predetermined reference value, fuel vapor learning correction means for setting a value of a fuel vapor learning correction factor when the fuel vapor is supplied to the intake air passage in such a manner that the center value of the fluctuation of the air-fuel ratio feedback correction factor agrees with the reference value, first air-fuel ratio correction means for setting a value of a first air-fuel ratio correction factor in accordance with the air-fuel ratio feedback correction factor and the feedback learning correction factor, second air-fuel ratio correction means for setting a value of a second air-fuel ratio correction factor in accordance with the air-fuel ratio feedback correction factor and the feedback learning correction factor and the fuel vapor learning correction factor, fuel supply control means for controlling the amount of fuel supplied to the engine in accordance with the first air-fuel ratio correction factor when the fuel vapor is not supplied to the intake air passage, and in accordance with the second air-fuel ratio correction factor when the fuel vapor is supplied to the intake air passage by the fuel vapor supply means, determining means for determining whether the value of the first air-fuel ratio correction factor is within a predetermined range when the fuel vapor supply means is supplying the fuel vapor to the intake air passage, and failure detecting means for stopping the fuel vapor supply means from supplying the fuel vapor to the intake air passage when the determining means determines that the value of the air-fuel ratio correction factor is larger than or smaller than the predetermined range, and after stopping the fuel vapor supply means, determining that the fuel supply system has failed if the value of the air-fuel ratio correction factor is larger than a predetermined upper limit value or lower than a predetermined lower limit value.

According to one aspect of the present invention, there is provided a failure detecting device for a fuel supply system of an internal combustion engine, comprising a fuel vapor supply device for supplying and stopping the fuel vapor from a fuel supply system to an intake air passage of an engine, an air-fuel ratio sensor disposed in an exhaust gas passage of the engine for detecting air-fuel ratio of an exhaust gas from the engine, an electronic control unit receiving an output signal from the air-fuel ratio sensor, and performing the functions of, a) calculating an air-fuel ratio feedback correction factor in accordance with the output signal from the air-fuel ratio sensor in such a manner that the output signal from the air-fuel ratio sensor becomes an output corresponding to a stoichiometric air-fuel ratio, b) calculating a feedback learning correction factor when the fuel vapor supply device is not supplying the fuel vapor to the intake air passage in such a manner that the center value of the fluctuation of the air-fuel ratio feedback correction factor agrees with a predetermined reference value, c) calculating a fuel vapor learning correction factor when the fuel vapor supply device is supplying the fuel vapor to the intake air passage in such a manner that the center value of the fluctuation of the air-fuel ratio feedback correction factor agrees with the reference value, d) calculating a first air-fuel ratio correction factor in accordance with the air-fuel ratio feedback correction factor and the feedback learning correction factor, e) calculating a second air-fuel ratio correction factor in accordance with the air-fuel ratio feedback correction factor and the feedback learning correction factor and the fuel vapor learning correction factor, f) controlling the amount of fuel supplied to the engine in accordance with the first air-fuel ratio correction factor when the fuel vapor supply device is not supplying the fuel vapor to the intake air passage, and in accordance with the second air-fuel ratio correction factor when the fuel vapor supply device is supplying the fuel vapor to the intake air passage, g) determining whether the value of the first air-fuel ratio correction factor is within a predetermined range when the fuel vapor supply device is supplying the fuel vapor to the intake air passage, and h) stopping the fuel vapor supply device from supplying the fuel vapor to the intake air passage when it is determined that the value of the air-fuel ratio correction factor is larger than or smaller than the predetermined range, and determining that the fuel supply system has failed if the value of the air-fuel ratio correction factor is larger than a predetermined upper limit value or lower than a predetermined lower limit value after the fuel vapor supply has been stopped.

Further, according to another aspect of the present invention, there is provided a method for detecting failure in a fuel supply system of an internal combustion engine comprising steps of, a) supplying and stopping the fuel vapor from a fuel supply system to an intake air passage of an internal combustion engine, b) detecting air-fuel ratio of an exhaust gas from the engine, c) setting an air-fuel ratio feedback correction factor in accordance with the air-fuel ratio of the exhaust gas in such a manner that the air-fuel ratio of the exhaust gas becomes a stoichiometric air-fuel ratio, d) setting a feedback learning correction factor when the fuel vapor is not supplied to the intake air passage in such a manner that the center value of the fluctuation of the air-fuel ratio feedback correction factor agrees with a predetermined reference value, e) setting a fuel vapor learning correction factor when the fuel vapor is supplied to the intake air passage in such a manner that the center value of the fluctuation of the air-fuel ratio feedback correction factor agrees with the reference value, f) setting a first air-fuel ratio correction factor in accordance with the air-fuel ratio feedback correction factor and the feedback learning correction factor, g) setting a second air-fuel ratio correction factor in accordance with the air-fuel ratio feedback correction factor and the feedback learning correction factor and the fuel vapor learning correction factor, h) controlling the amount of fuel supplied to the engine in accordance with the first air-fuel ratio correction factor when the fuel vapor is not supplied to the intake air passage and in accordance with the second air-fuel ratio correction factor when the fuel vapor is supplied to the intake air passage, i) determining whether the value of the first air-fuel ratio correction factor is within a predetermined range when the fuel vapor is supplied to the intake air passage, and j) stopping the fuel vapor supply to the intake air passage when it is determined that the value of the air-fuel ratio correction factor is larger than or smaller than the predetermined range, and determining that the fuel supply system has failed if the value of the air-fuel ratio correction factor is larger than a predetermined upper limit value or lower than a predetermined lower limit value after the fuel vapor supply has been stopped.

In this invention, a learning control of air-fuel ratio feedback correction factor (FAF) for causing the center value of the fluctuation of FAF to agree with a predetermined reference value is carried out using different correction factors in accordance with whether the fuel vapor from the fuel supply system is supplied to the engine. Namely, when the fuel vapor is not supplied to the engine, a feedback learning correction factor (KG) is used for the learning control of FAF, and when the fuel vapor is supplied to the engine, a fuel vapor learning correction factor (FGPG) is used for the learning control of FAF.

Further, when the fuel vapor is not supplied to the engine, the amount of the fuel supplied to the engine is controlled in accordance with the values of FAF and KG, and the value of FGPG is set at a predetermined reference value (for example, 0). When the fuel vapor is supplied to the engine, the amount of the fuel supplied to the engine is controlled in accordance with the values of FAF and FGPG, and the value of KG is held at a value before the fuel vapor supply started. According to the present invention, since only the fuel vapor learning factor FGPG changes to maintain the center value of FAF at the reference value when the fuel vapor is supplied, and the feedback learning correction factor KG does not change, the value of feedback learning correction factor KG is maintained at its value when the fuel vapor is not supplied. Therefore, the value of KG always corresponds to the deviation of the characteristics of the elements in the fuel supply system regardless of the fuel vapor supply to the engine.

In the present invention, the failure detection is carried out based on the value of a first air-fuel ratio correction factor which is determined in accordance with FAF and KG. Since the value of KG corresponds to the deviation of the characteristics of the elements in the fuel supply system, when the value of the first air-fuel ratio correction factor becomes larger than or smaller than a predetermined range, it is considered that the characteristics of the elements deviates largely from the design characteristics, i.e., a failure has occurred in the fuel supply system.

By using separate correction factors in accordance with whether the fuel vapor is supplied to the engine, it becomes possible to detect the failure in the system in which the fuel supply amount decreases.

Further, according to the present invention, the fuel vapor supply is stopped if the value of the first air-fuel ratio correction factor becomes larger than or smaller than a predetermined range during the fuel vapor supply, and the failure detection is repeated in order to improve the accuracy of the failure detection. When the amount of the fuel vapor supply changes suddenly during the fuel vapor supply period, or if the correction of the FAF using the fuel vapor learning correction factor FGPG is not completed, there is a possibility that the center value of FAF does not agree with the reference value. In such a case, if the failure detection is carried out based on the first air-fuel ratio correction factor, an error may occur. Therefore, in the present invention, if it is determined that there is a possibility of failure (i.e., if the value of the first air-fuel ratio correction factor becomes larger than or smaller than the predetermined range) when the fuel vapor is supplied to the engine, another failure detection is carried out after stopping the fuel vapor supply to the engine. In the second failure detection, if the value of the first air-fuel ratio correction factor becomes larger than an upper limit value or lower than a lower limit value, it is determined that the system has actually failed. Since the second failure detection is carried out in the condition in which the fuel vapor learning correction factor FGPG does not affect the value of FAF, the accuracy of the failure detection is improved. Further, the second failure detection is carried out only when the first failure detection (i.e., the failure detection carried out during the fuel vapor supply period) determines that the fuel supply system has failed, the frequency of carrying out the second failure detection (i.e., frequency of stopping the fuel vapor supply in order to carry out the failure detection) becomes less, and the operation of the evaporative emission control system is not hampered.

BRIEF DESCRIPTION OF THE DRAWINGS

The present invention will be better understood from the description as set forth hereinafter, with reference to the accompanying drawings, in which.

DESCRIPTION OF PREFERRED EMBODIMENTS

Embodiments of the present invention will be explained with reference to the accompanying drawings.

Figure 1:
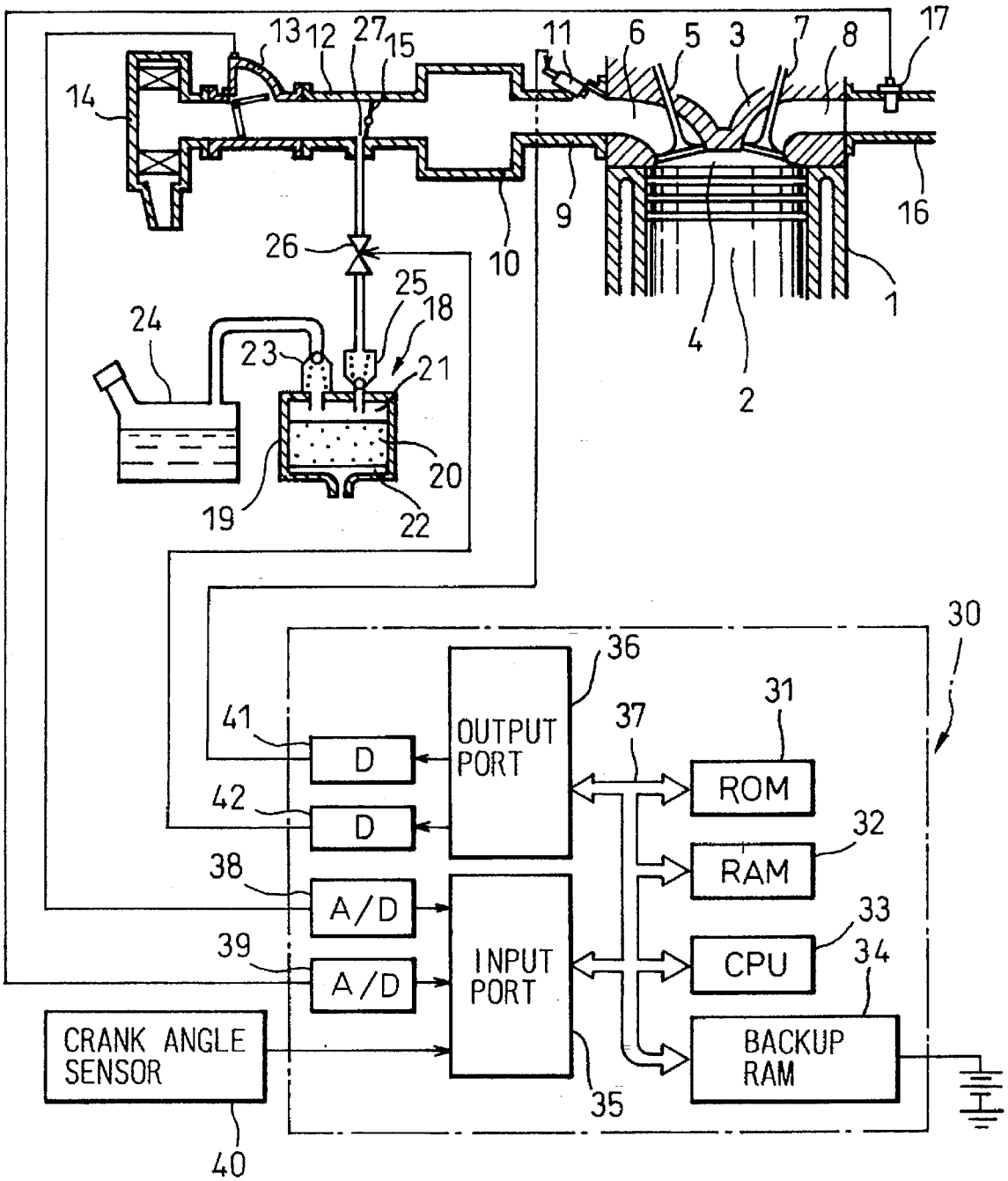
FIG. 1 is a drawing schematically illustrating an embodiment of the present invention when applied to an automobile engine.

FIG. 1 shows an embodiment of the failure detecting device according to the present invention when applied to an automobile engine.

In FIG. 1, reference numeral 1 designates an internal combustion engine, numeral 2 designates a piston of the engine 1, and numeral 3 and 4 designates a cylinder head and combustion chamber of the engine, respectively. On the cylinder head 3, an intake port 6 and an exhaust port 8 are provided on each cylinder of the engine (FIG. 1 shows one cylinder only). An intake valve 5 and an exhaust valve 7 are disposed in each of the inlet port 6 and the exhaust port 8, respectively. The intake port 6 of the respective cylinder is connected to a surge tank 10 via an intake manifold 9, and the surge tank 10 is further connected to an air-cleaner 14 by an intake air passage 12. Numeral 11 denotes a fuel injection valve which injects pressurized fuel into the intake port 6 in response to a drive signal from a control circuit 30. A throttle valve 15 which opens at a degree of opening in response to the amount of depression of an accelerator pedal (not shown) by a driver of the automobile is disposed in the intake air passage 12. In the intake air passage 12, further provided is an airflow meter 13 which generates a signal corresponding to the flow rate of intake air flowing through the intake air passage 12.

The exhaust port 8 is connected to a common exhaust gas passage (not shown) by an exhaust manifold 16. Numeral 17 in FIG. 1 is an air-fuel ratio sensor such as an $O_2$ sensor disposed in the exhaust manifold 16 for generating a voltage signal corresponding to the concentration of oxygen in the exhaust gas from the engine 1.

Numeral 18 in FIG. 1 designates an evaporative emission control device as a whole. The emission control device 18 in this embodiment includes a canister 19 which adsorbs the fuel vapor from the fuel in the fuel tank 24 of the engine 1. In the canister 19, an atmospheric chamber 22 which communicates with the atmosphere and a fuel vapor chamber 21 are provided. Further, an adsorbent 20 which is, for example, made of active carbon is filled in the canister 19. The fuel vapor chamber 21 is connected to the vapor space above the fuel in the fuel tank 24 via a check valve 23, and to the intake air passage 12 through a port 27, a solenoid valve 26 and a check valve 25. The position of the port 27 is determined in such a manner that the port 27 is positioned upstream of the throttle valve 15 when the valve 15 is in an idle position, and downstream of the valve 15 when the valve 15 opens at a predetermined degree of opening.

When the solenoid valve 26 is closed, the fuel vapor from the fuel tank 24 flows into the fuel vapor chamber 21 through the check valve 23 and is adsorbed by the adsorbent 20. In this embodiment, the solenoid valve 26 is usually opened during the operation of the engine. Therefore, when the throttle valve 15 is opened at the predetermined degree of opening, the negative pressure in the intake air passage downstream of the throttle valve 15 is introduced into the fuel vapor chamber 21 through the port 27, the solenoid valve 26 and the check valve 25. This causes the air in the atmospheric chamber 22 to flow into the fuel vapor chamber 21 through the adsorbent 20. When fresh air flows through the adsorbent 20, the fuel vapor adsorbed by the adsorbent 20 is released therefrom and is carried by the air to the fuel vapor 21. The mixture of air and the fuel vapor released from the adsorbent 20, then flows into the intake air passage 12 from the fuel vapor chamber 21 through the check valve 25, the solenoid valve 26 and the port 27. Therefore, when the solenoid valve 26 is opened during the operation of the engine 1, both the fuel vapor released from the adsorbent 20 and the fuel vapor from the fuel tank 24 flow into the intake air passage 12 through the port 27 and are burned in the combustion chamber 4 of the engine 1.

Numeral 30 in FIG. 1 designates a control circuit of the engine 1. The control circuit 30 may, for example, consist of a microcomputer of conventional type which comprises a ROM (read-only memory) 31, a RAM (random access memory) 32, a CPU (microprocessor) 33, a backup RAM 34, an input port 35 and an output port 36, all connected one another by a bi-directional bus 37. The backup RAM 34 is directly connected to a battery of the engine 1 and is capable of sustaining its memory content even when a main switch of the engine 1 is turned off. The control circuit 30 performs basic engine control such as fuel injection control and ignition timing control of the engine 1. Further, in this embodiment, the control circuit 30 performs failure detection of the fuel supply system as explained later in detail.

To perform these types of control, signals corresponding to the flow rate of the intake air and the air-fuel ratio of the exhaust gas is fed to the input port 35 from the airflow meter 13 and the $O_2$ sensor 17 via respective A/D converters 38 and 39. Further, a pulse signal representing an engine rotational speed is fed to the input port 35 from a crank angle sensor 40 disposed at a crankshaft of the engine 1. The output port 36 of the control circuit 30 is connected to the fuel injection valve 11 and the solenoid valve 26 through the respective drive circuits 41 and 42, to control an opening period, i.e., the fuel injection amount of the fuel injection valve 11 and opening and closing of the solenoid valve 26.

The fuel injection amount TAU is calculated by the following formula in this embodiment.

$$TAU=TP\times(FAF+KG+FGPG)\times T_1+T_2 \quad (2)$$

TP in the above formula represents a basic fuel injection amount which is a fuel amount to make the operating air-fuel ratio of the engine 1 stoichiometric. The basic fuel injection amount TP is determined in advance by, for example, an experiment using the actual engine, and stored in the ROM 31 as a function of an engine load (for example, a function of the ratio of the amount of the intake air per one revolution of the engine, Q/N). FAF, KG and FGPG represent an air-fuel ratio feedback correction factor, a feedback learning correction factor and a fuel vapor learning correction factor, respectively. FAF, KG and FGPG will be explained later in detail. $T_1$ and $T_2$ are constants determined by the operating conditions (such as the temperature of the engine).

The air-fuel ratio feedback correction factor FAF, the feedback learning correction factor KG and the fuel vapor learning correction factor FGPG are explained hereinafter with reference to FIGS. 2 through 7.

Figure 2:
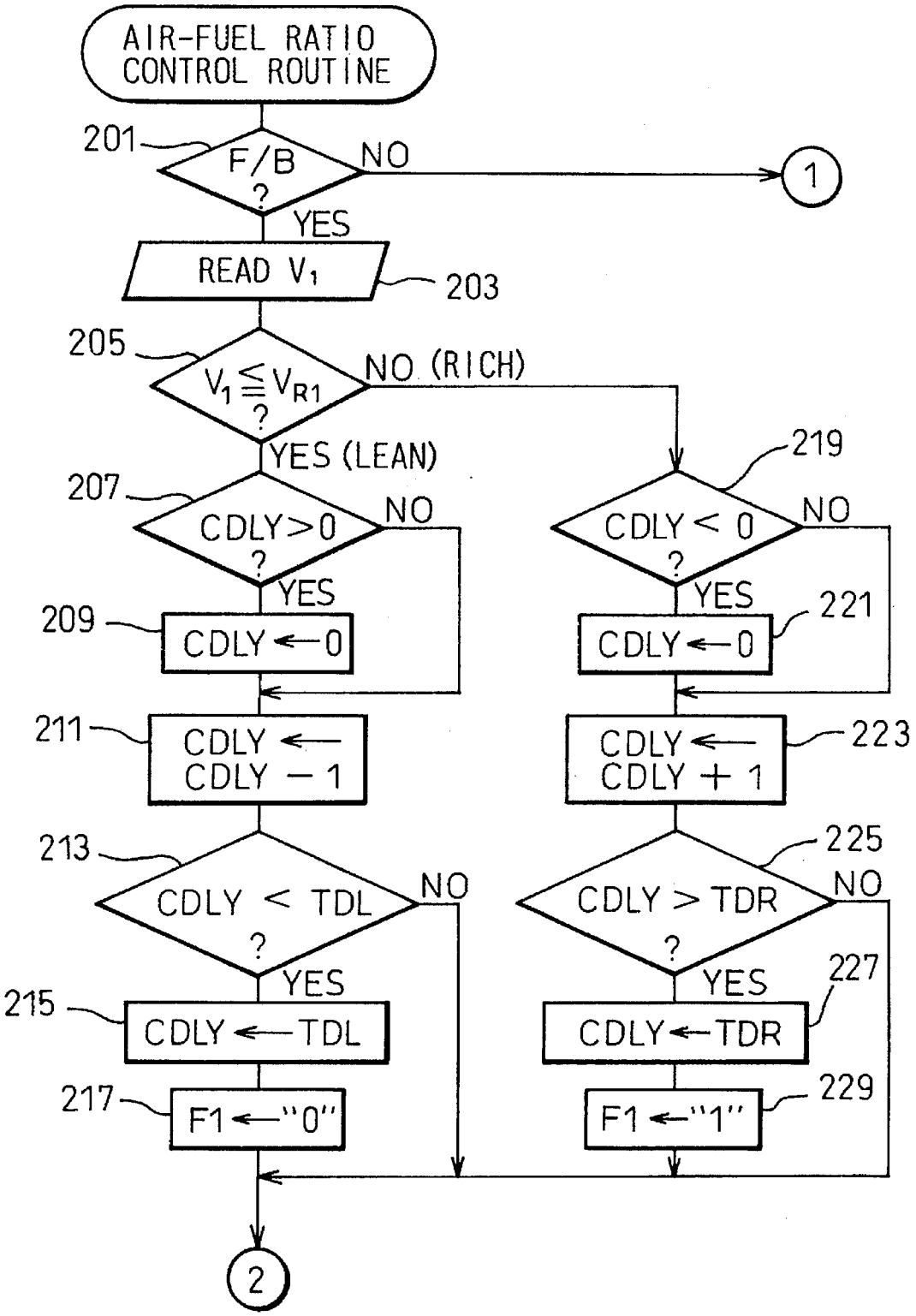
FIG. 2 and FIG. 3 are a flowchart illustrating an example of the air-fuel ratio control of the engine used in the embodiment in FIG. 1.
Figure 3:
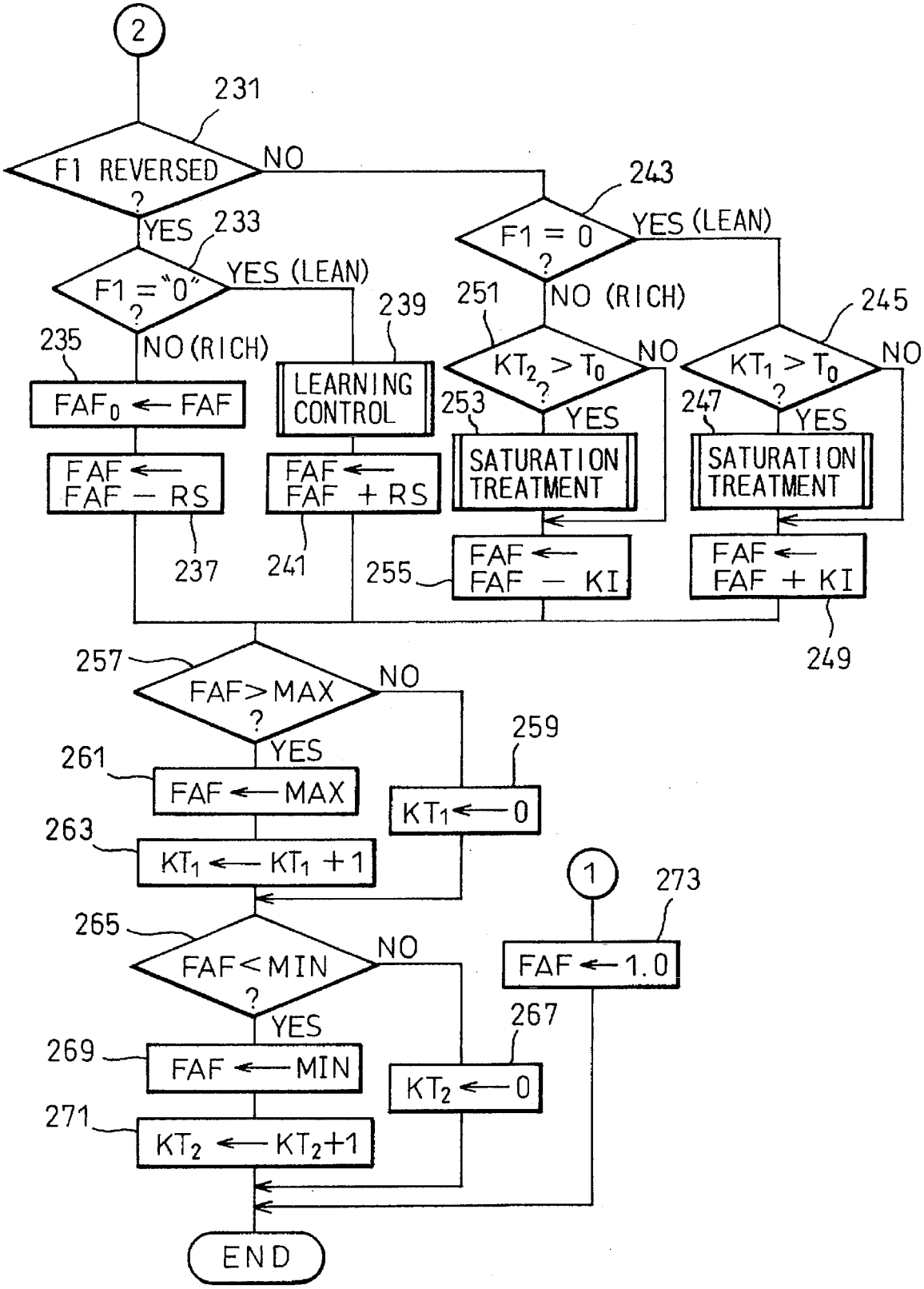

FIGS. 2 and 3 are a flowchart illustrating a routine for calculating the air-fuel ratio feedback correction factor FAF. This routine is executed by the control circuit 30 at predetermined intervals. In the routine in FIGS. 2 and 3, the value of the air-fuel ratio feedback correction factor FAF is decreased when an output voltage signal $V_1$ of the $O_2$ sensor 17 is higher than a reference voltage $V_{R1}$ (i.e., $V_1>V_{R1}$), and is increased when the output $V_1$ is lower than or equal to the reference voltage $V_{R1}$ (i.e., $V_1\leqq V_{R1}$). The reference voltage $V_{R1}$ is an output voltage of the $O_2$ sensor 17 which corresponds to the stoichiometric air-fuel ratio. The $O_2$ sensor 17 outputs voltage signal of, for example, 0.9 V when the air-fuel ratio of the exhaust gas is on a rich side compared to the stoichiometric air-fuel ratio, and of 0.1 V, for example, when the air-fuel ratio of the exhaust gas is on a lean side compared to the stoichiometric air-fuel ratio. The reference voltage of the $O_2$ sensor is set at 0.45 V, for example, in this embodiment. By adjusting the value of FAF in accordance with the air-fuel ratio of the exhaust gas, the air-fuel ratio of the engine is maintained near the stoichiometric air-fuel ratio even if the characteristics of the elements in the fuel supply system such as the airflow meter 13 and the fuel injection valve 11 deviates from the design characteristics by a certain amount.

The flowchart in FIGS. 2 and 3 is explained in brief. When the routine starts in FIG. 2, at step 201, it is determined whether the conditions for performing the air-fuel ratio feedback control are satisfied. The conditions determined at step 201 are, for example, whether the $O_2$ sensor 17 is activated, whether the engine 1 is warmed up. If these conditions are satisfied at step 201, the routine proceeds to steps 203 and after, to calculate the value of FAF. If any of conditions is not satisfied, the routine terminates after setting the value of FAF at 1.0 at step 273 in FIG. 3.

Steps 203 through 229 in FIG. 2 are steps for determining air-fuel ratio of the exhaust gas. F1 in steps 217 and 219 is a flag representing whether the air-fuel ratio of the exhaust gas is on a rich side (F1=1) or on a lean side (F1=0) compared to the stoichiometric air-fuel ratio. The value of F1 is switched (reversed) from 0 to 1 (a lean condition to a rich condition) when the $O_2$ sensor 17 continuously outputs a rich signal (i.e., $V_1>V_{R1}$) for more than a predetermined time period (TDR) (steps 205 and 207 through 217). Similarly, the value of F1 is switched (reversed) from 1 to 0 (a rich condition to a lean condition) when the $O_2$ sensor 17 continuously outputs a lean signal ($V_1\leqq V_{R1}$) for more than a predetermined time period (TDL) (steps 205 and 219 through 229). CDLY in the flowchart is a counter for determining the timing for reversing the value of the flag F1.

At steps 231 through 255, the value of FAF is adjusted in accordance with the value of the flag F1 set by the steps explained above. At step 231, it is determined whether the air-fuel ratio of the exhaust gas is reversed (i.e., from a rich air-fuel ratio to a lean air-fuel ratio, or vice versa) since the routine was last executed, by determining whether the value of F1 changed from 1 to 0 or 0 to 1. If the value of F1 changed from 1 to 0 (a rich condition to a lean condition) since the routine was last executed (steps 231 and 233), the value of FAF is increased step-wise by a relatively large amount RS (step 241), and if the value of F1 changed from 0 to 1 (a lean condition to a rich condition) since the routine was last executed (steps 231 and 233), the value of FAF is decreased step-wise by a relatively large amount RS (step 241). If the value of F1 did not change since the routine was last executed, the value of FAF is increased gradually as long as the value of F1 is 0 (steps 231, 243 and 249) and decreased gradually as long as the value of F1 is 1 (steps 231, 243 and 255) by a predetermined amount KI every time the routine is executed. Further, the value of the FAF is restricted by the maximum value MAX (for example, MAX=1.2) and the minimum value (for example, MIN=0.8) to keep the value of FAF within the range determined by the values of MAX and MIN (steps 257 through 271).

Further, if the value of FAF changed from 0 to 1 since the routine was last executed, the value of FAF immediately before it is increased step-wise is stored in the RAM 32 as $FAF_0$ at step 235. If the value of FAF changed from 1 to 0 since the routine was last executed, the value of the feedback learning correction factor KG and the fuel vapor learning correction factor FGPG are determined by learning control subroutines explained later (step 239).

In addition, if the value of FAF is larger than the maximum value MAX at step 257 or smaller than the minimum value MIN at step 265, counters $KT_1$ or $KT_2$ are incremented at steps 263 and 271, respectively. The value of the counters $KT_1$ and $KT_2$ are set to 0 when the value of FAF is within the range between MAX and MIN. Therefore, the values of the counters $KT_1$ and $KT_2$ correspond to the time which has elapsed since the value of FAF reached the maximum value MAX or the minimum value MIN and restricted by the steps 261 or 269. When the value of FAF reaches the values MAX or MIN, the value of FAF cannot increase or decrease further, and it is forcibly held at MAX or MIN. These conditions are hereinafter referred to as "saturation of FAF". Therefore, the value of counters $KT_1$ and $KT_2$ represent the time period in which the saturation of FAF continues. In this embodiment, the learning control subroutines for adjusting the value of KG and FGPG is executed only when the value of F1 changed from 1 to 0 (step 239). However, when FAF is saturated, the value of F1 stays at 1 or 0, and the reversal of the value of F1 does not occur as long as the saturation of FAF continues. In this case, also the learning control subroutine is not executed as long as the saturation of FAF continues, and the values of KG and FGPG are held at the same values which do not correspond to the current conditions of the engine. Therefore, in this embodiment, if the time period $KT_1$ or $KT_2$ exceeds a predetermined value (steps 245 or 251), i.e., if the saturation of FAF continues for more than a predetermined time period, another learning control subroutine (a saturation treatment subroutine) is carried out at steps 247 or 253 as explained later. Namely, in the routine in FIGS. 2 and 3, the values of KG and FGPG are usually determined in the learning control subroutine every time when the value of F1 changes from 1 to 0, however, if the saturation of FAF continues for more than a predetermined time period, the values of KG and FGPG are determined by the saturation treatment subroutine even though the value of F1 does not change.

Figure 4:
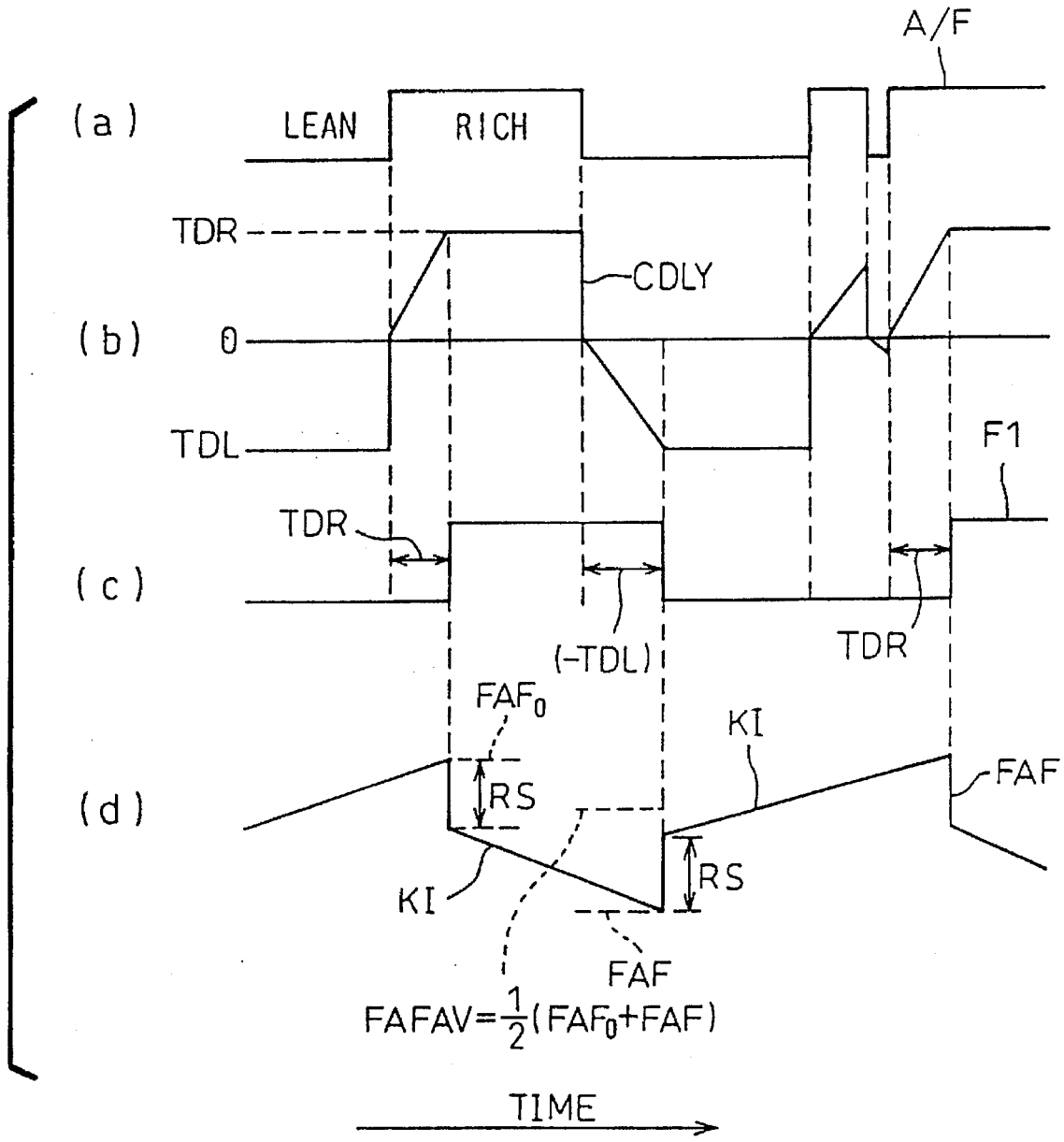
FIG. 4 is a timing diagram explaining the air-fuel ratio control in FIG. 2 and FIG. 3.

FIG. 4 shows changes in the values of the counter CDLY (curve (b) in FIG. 4), the flag F1 (curve (c) in FIG. 4) and FAF (curve (d) in FIG. 4) in accordance with the change in the air-fuel ratio (A/F) of the engine (curve (a) in FIG. 4) when the air-fuel ratio is controlled by the routine in FIGS. 2 and 3. As shown in FIG. 4, the value of FAF fluctuates around a center value (FAFAV in FIG. 4, for example) corresponding to the stoichiometric air-fuel ratio. Namely, in the ideal condition in which the characteristics of the elements in the fuel supply system such as the airflow meter and fuel injection valve agree with the design characteristics, the air-fuel ratio feedback correction factor FAF fluctuates around the center value of 1.0, and the value 1.0 corresponds to the stoichiometric air-fuel ratio. In the actual operation of the engine, if the characteristics of the elements in the fuel supply system deviates from the design characteristics due to a lapse of time or inherent deviations of the individual elements, the value of FAF corresponding to the stoichiometric air-fuel ratio also deviates from 1.0, and FAF fluctuates around the center value which deviates from 1.0. In this case, since the deviations of the characteristics of elements in the fuel supply system are compensated by the change in the value of FAF, the fuel injection amount is always maintained at the value required for obtaining the stoichiometric air-fuel ratio even if the characteristics of the elements deviate from the designed value.

However, as explained in FIG. 3, the change in the value of FAF is restricted by the maximum value MAX and the minimum value MIN (steps 257 through 271 in FIG. 3). Therefore, if the center value of FAF deviates from 1.0, the controllable air-fuel ratio range becomes narrow. For example, if the FAF fluctuates around the center value 1.1, since the value of FAF is restricted by the maximum value 1.2 (MAX), the value of FAF can change in the range between 1.1 and 1.2 on a lean air-fuel ratio side, and a lean air-fuel ratio which requires the value of FAF larger than 1.2 for correcting the air-fuel ratio to the stoichiometric air-fuel ratio cannot be corrected by FAF. Further, when the air-fuel ratio control in FIGS. 2 and 3 is not performed, the value of FAF is set to 1.0 (step 273 in FIG. 3). Therefore, if the air-fuel ratio control is terminated when the center value of FAF deviates from 1.0 (for example, FAF=1.1), the center value of FAF changes suddenly from 1.1 to 1.0 due to the termination of the air-fuel ratio control. This sudden change in FAF is not preferable since it causes a sudden change in the engine output torque.

In this embodiment, in order to prevent such problems, FAF is corrected by learning control using the feedback learning correction factor KG and the fuel vapor learning correction factor FGPG. Next, the learning control is explained.

In this embodiment, the learning control of FAF is performed by adjusting the value of the feedback learning correction factor KG when the fuel vapor is not supplied to the engine (i.e., when the solenoid valve 26 in FIG. 1 is closed), and the learning control of FAF is performed by adjusting the fuel vapor learning correction factor FGPG when the fuel vapor is supplied to the engine (i.e., when the valve 26 is opened). Further, the value of the fuel vapor learning correction factor FGPG is set at 0 when the fuel vapor is supplied to the engine, and the value of the feedback learning correction factor KG is held at the value before the fuel vapor supply is started.

For example, if the center value of FAF (the value corresponds to the stoichiometric air-fuel ratio) deviates from 1.0 when the fuel vapor is not supplied to the engine, the value of the feedback learning correction factor KG is adjusted in such a manner that the center value of FAF agrees with 1.0 while keeping the value of the fuel vapor learning correction factor FGPG at 0. More specifically, if the center value of FAF becomes 1.1 due to the change in the characteristics of the elements in the fuel supply system when the fuel vapor is not supplied to the engine, the value of feedback learning correction factor KG is set at 0.1 to, thereby decrease the center value of FAF to 1.0. In this case, the value 0.1 of KG corresponds to the amount of the deviation of the characteristics of the elements. Though the center value of FAF and the value of KG are changed, the changes in FAF and KG cancel each other, and the value of (FAF+KG) fluctuates around the center value of 1.1. Therefore, the air-fuel ratio of the engine is maintained at the stoichiometric air-fuel ratio, and the value of KG is set to a value (either a positive or negative) corresponding to the deviation of the characteristics of the elements in the fuel supply system.

On the other hand, when the fuel vapor is supplied to the engine, the value of the fuel vapor learning correction factor FGPG is adjusted to keep the center value of FAF at 1.0 while holding the value of KG at the value before the fuel vapor supply is started. Since the amount of the fuel supplied to the engine increases when the fuel vapor is supplied to the engine, the center value of FAF temporarily decreases to maintain the air-fuel ratio at the stoichiometric air-fuel ratio at the beginning of the fuel vapor supply. However, if the center value of FAF is decreased, for example, to 0.9 by the fuel vapor supply, the value of the fuel vapor learning correction factor FGPG is set to −0.1, to thereby increase the center value of FAF to 1.0. The value −0.1 of FGPG, in this case, corresponds to the amount of fuel vapor supplied to the engine. Therefore, also in this case, the center value of FAF becomes 1.0 while maintaining the center value of the fluctuation of the value (FAF+KG+FGPG) at 0.9, and the air-fuel ratio of the engine is maintained at the stoichiometric air-fuel ratio. FGPG takes a value (either positive or negative) corresponding to the amount of fuel vapor supplied to the engine.

Figure 5:
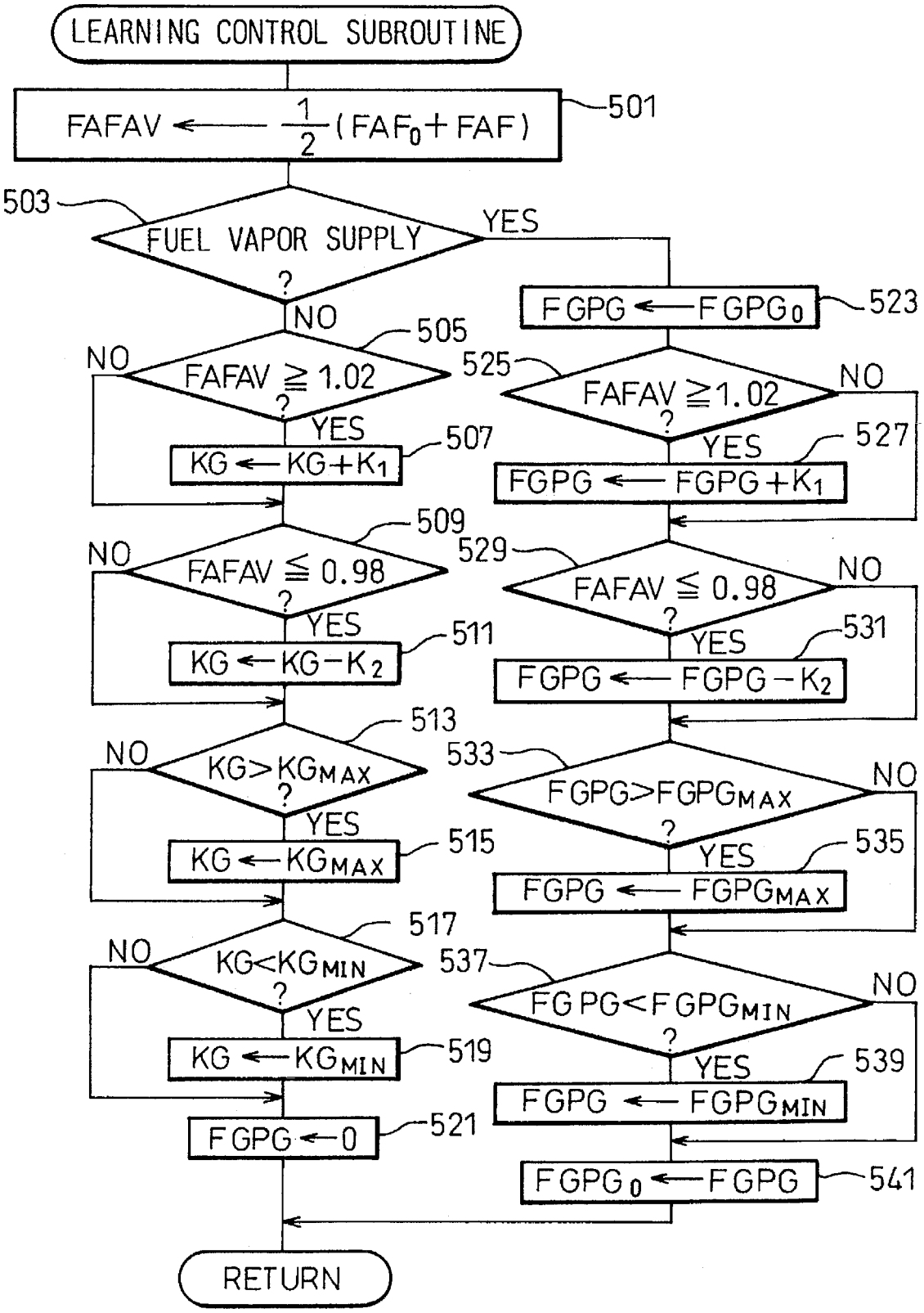
FIG. 5 through FIG. 7 are flowcharts illustrating a learning control of an air-fuel ratio feedback correction factor FAF in the embodiment in FIG. 1.

FIG. 5 is a flowchart showing a learning control subroutine which is performed at step 239 in FIG. 3 to adjust the value of the feedback learning correction factor KG and the fuel vapor learning correction factor FGPG. This routine is performed by the control circuit 30. In this subroutine, the values of KG and FGPG are adjusted in accordance with the value of FAFAV. FAFAV is an arithmetic mean of $FAF_0$, which is the value of FAF immediately before the value of F1 changed from 0 to 1 (step 235 in FIG. 3 and the curve (d) in FIG. 4) and the value of FAF immediately after the value of F1 has changed from 1 to 0, i.e., $FAFAV=(FAF_0+FAF)/2$. In the subroutine, it is assumed that FAFAV corresponds to the stoichiometric air-fuel ratio.

In FIG. 5, at step 501, the value FAFAV is calculated, and at step 503, it is determined whether the fuel vapor is currently supplied to the engine (i.e., whether the solenoid valve 26 is opened). If the fuel vapor is not supplied, steps 505 through 521 are performed to adjust only the value of feedback learning correction factor KG, and the value of FGPG is set at 0 (step 521).

At steps 505 through 521, if the value of FAFAV is larger than or equal to a predetermined value (which is larger than 1.0, and in this embodiment, set at 1.02), the value of KG is decreased by an amount $K_1$ (for example, $K_1=0.01$) (steps 505 and 507), and if the value of FAFAV is smaller than or equal to a predetermined value (which is smaller than 1.0, and in this embodiment, is set at 0.98) (steps 509 and 511), the value of KG is increased by an amount $K_2$ (for example, $K_2=0.01$). If the value of KG is between these values (1.02>FAFAV>0.98), the value of KG remains unchanged.

Further, at step 513 through 519, the value of KG adjusted by the steps 505 through 511 are restricted by the maximum value $KG_{MAX}$ and the minimum value $KG_{MIN}$, and the subroutine terminates this time after setting the value of FGPG to 0 at step 521.

On the other hand, if the fuel vapor is supplied to the engine at step 503, steps 523 through 541 are performed to adjust only the value of the fuel vapor learning correction factor FGPG while keeping the value of KG unchanged. Since steps 525 through 539 are the similar steps to steps 509 through 519 explained above, the explanation thereof is not repeated here.

In this embodiment, the value of FGPG after it is adjusted is stored in the backup RAM 34 as $FGPG_0$ (step 541), and the adjustment of the value of FGPG is started from this value (step 523). Therefore, when the fuel vapor supply is newly started, the adjustment of the value of FGPG starts from the value reflecting the adjustment incorporated during the fuel vapor supply last performed.

Figure 6:
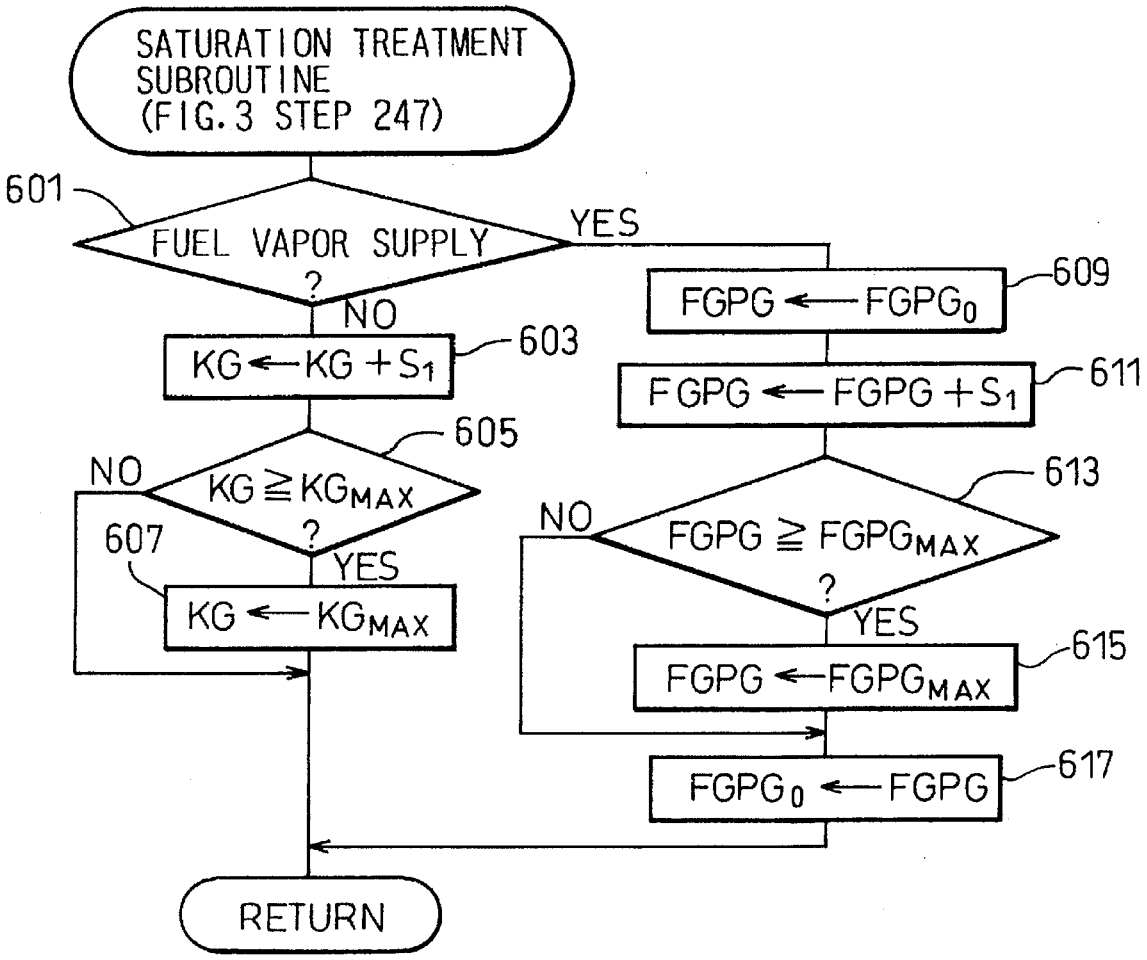
Figure 7:
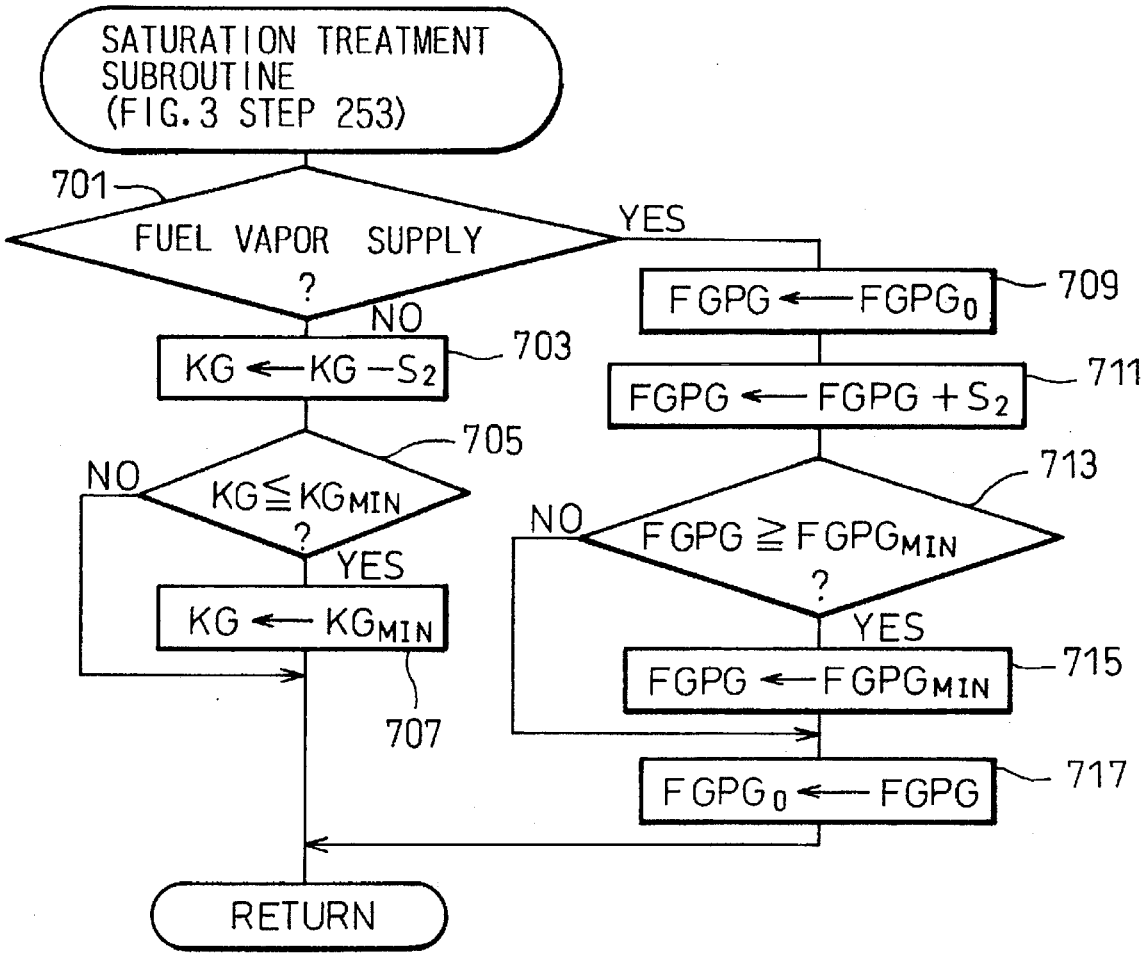

FIGS. 6 and 7 are flowcharts showing the saturation treatment subroutines executed at step 247 and 253 in FIG. 3. As explained before, the saturation treatment subroutines are executed when the saturation of FAF continues for more than a predetermined time period to adjust the values of KG and FGPG.

The flowchart in FIG. 6 illustrates the saturation treatment subroutine performed at step 247. This routine is performed when FAF saturates at the maximum value MAX. In this subroutine, either the value of KG or of FGPG is increased by an amount $S_1$ in accordance with whether the fuel vapor is supplied to the engine, as shown in FIG. 6. The value $S_1$ is set at smaller value than $K_1$ in FIG. 5, and is set at 0.001, for example, in this embodiment. The flowchart in FIG. 7 illustrates the saturation treatment subroutine performed at step 253. This routine is performed when FAF saturates at the minimum value MIN. In this subroutine, either the value of KG or of FGPG is decreased by an amount $S_2$ in accordance with whether the fuel vapor is supplied to the engine, as shown in FIG. 7. The value $S_2$ is, for example, set at 0.001 in this embodiment. By the subroutines in FIGS. 6 and 7, the values of KG and FGPG are changed even when the FAF is saturated at the maximum value or the minimum value. Therefore, the value of FAF is forcibly changed even in this case and, thereby, the saturation of FAF terminates in a short time.

As explained above, when the values of KG or FGPG are increased, the value of FAF decreases by the routine in FIGS. 2 and 3, and when the values of KG and FGPG is decreased, the value of FAF increases. Therefore, by performing the subroutine in FIG. 5 every time when the value of F1 changes from 1 to 0, the center value of FAF (i.e., FAFAV) is maintained within a predetermined range (for example, 0.98 to 1.02 in this embodiment) regardless of whether the fuel vapor is supplied to the engine. The values of KG and FGPG are stored in the backup RAM 34 and preserved even when the main switch of the engine is turned off. Therefore, when the engine is next started, the value of FAF is maintained within the predetermined range from the instant at which the engine is started.

Next, the reason why the separate correction factors (KG and FGPG) are used in accordance with whether the fuel vapor is supplied to the engine is explained.

When the fuel vapor is supplied to the engine, since the center value of FAF is adjusted by changing the value of FGPG, it is not necessary to change the value of KG. Therefore, KG in this embodiment is always maintained at a value represent the degree of deviation of the characteristics of the elements in the fuel supply system regardless of whether the fuel vapor is supplied to the engine. Therefore, if the correction of the center value of FAF by the fuel vapor learning correction factor FGPG is completed (i.e., if the center value of FAF agrees with 1.0), the degree of the deviation of the characteristics of the elements can be determined by the value (FAF+KG) even when the fuel vapor is supplied to the engine. In other words, regardless of whether the fuel vapor is supplied to the engine, if the value (FAF+KG) becomes larger than or smaller than a predetermined range, it is considered that the deviation of the characteristics of the elements is excessively large (i.e., the fuel supply system has failed).

The value of KG corresponds to the degree of the deviation of the characteristics of the elements. Therefore, the value of KG usually changes gradually with a lapse of time, and does not change suddenly. The value of FGPG corresponds only to the amount of the fuel vapor supplied to the engine. Therefore, by setting the value of FGPG to 0 when the fuel vapor supply is stopped, the center value of the FAF is maintained at 1.0 even at the instant immediately after the fuel vapor supply has been stopped and, thereby the controllable range of FAF is not narrowed even after the fuel vapor supply has been stopped.

Figure 8:
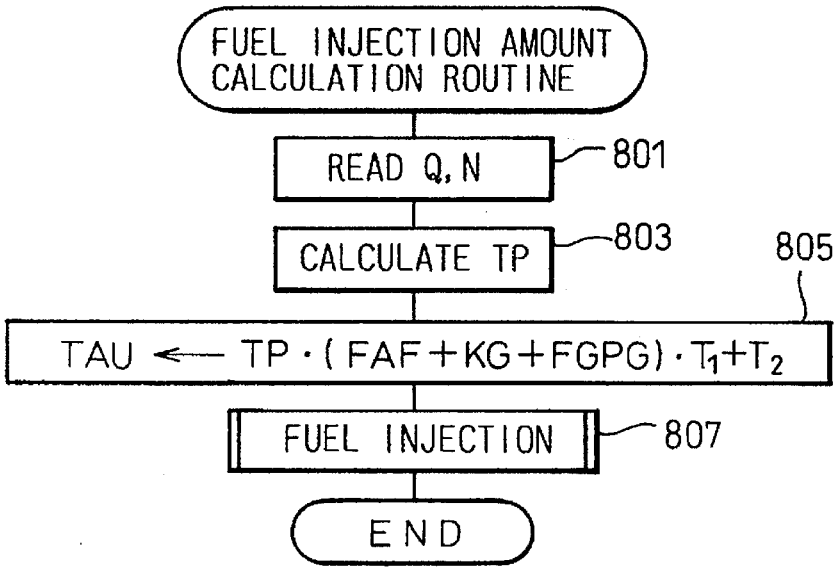
FIG. 8 is a flowchart illustrating an example of the calculation of a fuel injection amount of the engine.

FIG. 8 is a flowchart illustrating the fuel injection amount calculation routine. This routine is performed by the control circuit 30 at predetermined intervals, or at predetermined crank rotation angles (for example, every 360° rotation of crankshaft). In FIG. 8, at step 801, an intake airflow amount Q and the engine speed N are read from the airflow meter 13 and the crank angle sensor 40, respectively. Then, at step 803 the amount of intake air per one revolution of the engine Q/N is calculated, and the basic fuel injection amount TP is calculated from the function stored in the ROM 31 based on the value of Q/N. At step 805, the actual fuel injection amount TAU is calculated by the following formula.

$$TAU=TP\times(FAF+KG+FGPG)\times T_1+T_2$$

As explained before, the value of the fuel vapor learning correction factor FGPG is set to 0 when the fuel vapor is not supplied to the engine, and the value of the feedback learning correction factor KG is held at a constant value when the fuel vapor is supplied to the engine.

At step 807, the amount of the fuel corresponds to TAU is injected from the fuel injection valve 11.

Next, a method for detecting the failure in the fuel supply system in this embodiment is explained.

As explained before, since the separate correction factor KG and FGPG are used in accordance with whether the fuel vapor is supplied to the engine, the value (FAF+KG) always corresponds to the degree of the deviation of the characteristics of the elements in the fuel supply system, according to the present embodiment. Therefore, the failure of the fuel supply system can be determined based on the value (FAF+KG) regardless of whether the fuel vapor is supplied to the engine in this embodiment. However, when the amount of the fuel vapor supplied to the engine suddenly changes, an error in the failure detection may occur if the failure is determined in accordance with the value (FAF+KG) during the fuel vapor supply period.

Since the value of FGPG is gradually changed by the subroutine in FIG. 5 to prevent an excessive correction, if the amount of the fuel vapor supplied to the engine changes suddenly, the center value of FAF deviates from 1.0 until the value of FGPG changes a sufficient amount. This means that after the amount of the fuel vapor has changed suddenly, the center value of FAF may deviate from 1.0 for a certain period. Further, if the amount of the fuel vapor changes largely, the saturation of FAF may occur. When the saturation of FAF occurs, the subroutine in FIG. 5 is not performed any more, and the value of FGPG is adjusted only by the saturation treatment subroutines in FIGS. 6 or 7. However, in the saturation treatment subroutine, the amount of change in the value of FGPG ($S_1$ and $S_2$) is much smaller than that in FIG. 5 ($K_1$ and $K_2$). Therefore, once the saturation of FAF occurs due to the change in the amount of the fuel vapor, the time period required for adjusting the center value of FAF becomes longer.

If the failure detection based on the value (FAF+KG) is performed in this period, an error in failure detection, in which the fuel supply system is incorrectly determined as having failed, may occur, since the value of FAF becomes large. For example, assume that the center value of FAF is 1.0 and the value of KG is 0.1 when the fuel vapor is supplied to the engine. In this case, the value (FAF+KG) is 1.1 and much lower than the value to determine that the fuel supply system has failed. However, if the center value of FAF increased from 1.0 to 1.2 due to sudden decrease in the amount of fuel vapor supplied to engine, the value (FAF+KG) also increases to 1.3 and stays at this value until the value of FGPG changes sufficient amount. In this case, if a reference value of (FAF+KG) for determining the failure is set at the value less than 1.3, the system is incorrectly determined as having failed even though the system is normal.

In this embodiment, considering the above-mentioned problem, when the fuel supply system is determined as having failed during the fuel vapor supply period, the failure detection based on the value (FAF+KG) is performed again after stopping the fuel supply to the engine. When the fuel vapor supply to the engine is stopped, the amount of fuel vapor supplied to the engine becomes 0, and also the value of FGPG is set to 0. Therefore, the influence of the fuel vapor over the value of FAF is completely eliminated and, thereby the value of (FAF+KG) represents correctly whether a failure exists in the fuel supply system. Thus, by performing the failure detection again after stopping the fuel vapor supply, the error in the failure detection can be completely eliminated.

It was considered heretofore that the case in which the amount of the fuel vapor suddenly decreases is not likely to occur during the fuel vapor supply to the engine. However, it is found that there are cases in which the amount of fuel vapor suddenly decreases. For example, when fuel is charged in the tank, since the fuel level in the fuel tank is raised and the space of the fuel tank above the fuel level becomes small, the amount of the fuel vapor from the fuel tank suddenly decreases after the fuel was charged. Also, when a fuel filler cap of the fuel tank is opened to charge fuel to the fuel tank, the amount of fuel supplied to the engine decreases suddenly.

Further, a sudden decrease of the fuel vapor may occur even during the operation of the engine. When the atmospheric pressure increases, the amount of the fuel vapor evaporated from the fuel in the fuel tank decreases. Therefore, when the automobile descends a long slope using an engine brake from a high altitude place, if the change in the altitude is large, a sudden decrease in the fuel vapor occurs when the engine brake is stopped. Since fuel is not supplied to the engine during the engine brake operation, the air-fuel ratio control in FIGS. 2 and 3 is not carried out during the engine brake operation, and the value of FGPG is held at the value before the engine brake operation started. Therefore, if the change in the altitude during the engine brake operation is large, the value of FGPG remains unchanged from the value corresponds to the fuel vapor amount in a high altitude place (i.e., large amount of fuel vapor) when the air-fuel ratio control in FIGS. 2 and 3 is restarted. In this case, since the change (decrease) in the altitude is large, actually the amount of fuel vapor becomes smaller when the air-fuel ratio control is restarted, the value of FAF changes (increases) largely as if the amount of fuel vapor decreased suddenly.

Since this embodiment is also directed to the detection of the failure in which the fuel injection amount decreases (i.e., the failure in which the value (FAF+KG) increases), it is necessary to consider the case in which the amount of fuel vapor decreases suddenly to prevent the error in failure detection when the fuel vapor is supplied to the engine. Therefore, in this embodiment, when the failure is detected when the fuel vapor is supplied to the engine, the failure detection is performed again after stopping the fuel vapor supply to the engine to eliminate the possibility of the error in the failure detection.

The actual failure detecting operation of the present embodiment is now explained with reference to FIGS. 9 and 10.

Figure 9:
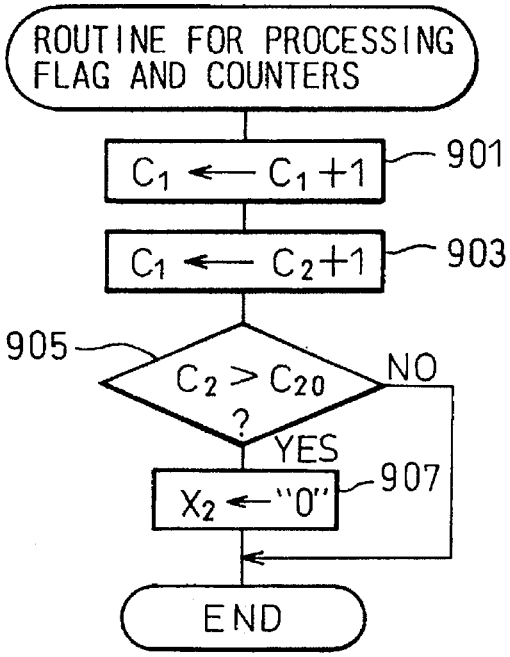
FIG. 9 and FIG. 10 are flowcharts illustrating an example of the failure detecting routine.

FIG. 9 is a flowchart showing a routine for processing counters $C_1$, $C_2$ and a flag $X_2$. The counters $C_1$, $C_2$ and the flag $X_2$ are used in the failure detecting routine (FIG. 10) explained later. The routine in FIG. 9 is processed by the control circuit 30 at predetermined intervals. In FIG. 9, the value of the counters $C_1$ and $C_2$ are increased by 1 at steps 901 and 903, respectively. Therefore, the values of the counters $C_1$ and $C_2$ continue to increase until they are reset in another routine. At step 905, the value of the counter $C_2$ is tested to determine whether it has become larger than a predetermined value $C_{20}$. If the value of $C_2$ is larger than $C_{20}$, the value of the flag $X_2$ is reset to 0 at step 907. Namely, the flag $X_2$ is reset to 0 every time when the value of the counter $C_2$ exceeds the predetermined value $C_{20}$.

Figure 10:
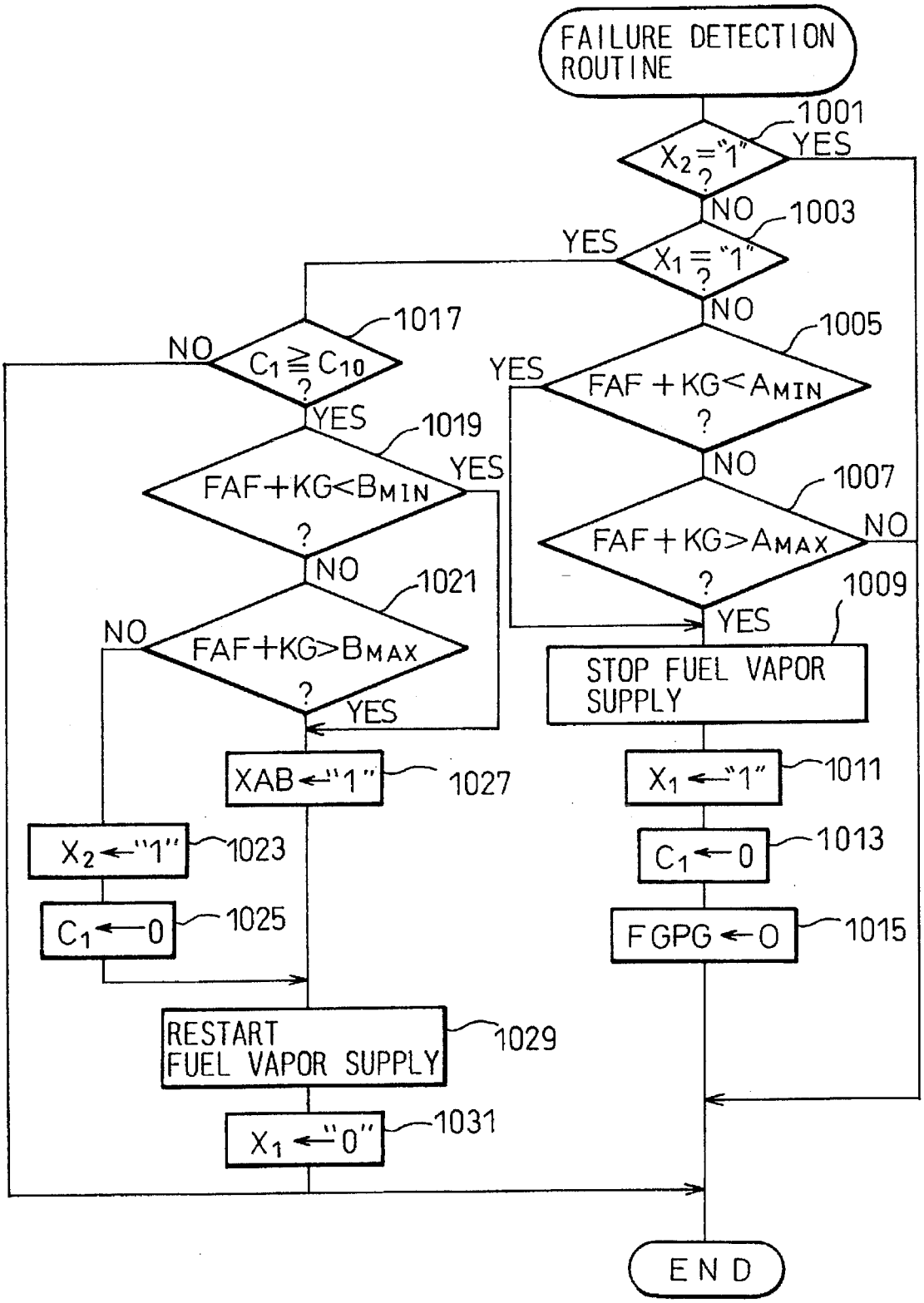

FIG. 10 is a flowchart illustrating a failure detection routine in this embodiment. This routine is processed by the control circuit 30 at predetermined intervals. In FIG. 10, at step 1001, it is determined whether the value of the flag $X_2$ is set at 1. Usually, the value of the flag $X_2$ is set to 0 by the routine in FIG. 9. Therefore, the routine proceeds this time to step 1003 which determines whether the value of a flag $X_1$ is set to 0. The value of the flag $X_1$ is also usually set to 0 at step 1031 as explained later, the routine proceeds to step 1005 this time.

At steps 1005 and 1007, it is determined whether the value (FAF+KG) is within the range between the predetermined values $A_{MAX}$ and $A_{MIN}$. If the value (FAF+KG) is within the range between $A_{MAX}$ and $A_{MIN}$, since it is considered that there is no failure in the fuel supply system, the routine terminates immediately. If the value (FAF+KG) is not in the above noted range, i.e., if (FAF+KG)<$A_{MIN}$ or (FAF+KG)>$A_{MAX}$, the routine executes steps 1009 through 1015. At step 1009, the solenoid valve 26 is closed to stop the fuel vapor supply from the canister 19, and at step 1011, the value of the flag $X_1$ is set to 1. Further, the value of the counter $C_1$ is reset to 0 at step 1013, and the value of the fuel vapor learning correction factor FGPG set to 0 at step 1015. By executing step 1013, the value of the counter $C_1$ corresponds to the time which has elapsed since the fuel vapor supply was stopped, and by executing step 1015, the fuel injection amount TAU is determined only by the value (FAF+KG), and the value (FAF+KG) itself precisely corresponds to whether the fuel supply system has failed.

When the routine is processed next time, since the value of the flag $X_1$ is set to 1, the routine proceeds from step 1003 to 1017. At step 1017, it is determined whether the value of the counter $C_1$ reaches a predetermined value $C_{10}$, i.e., it is determined whether a predetermined time has elapsed after the fuel vapor supply has been stopped, and if the time has not elapsed, the routine terminates immediately. If the predetermined time has elapsed ($C_1 \geqq C_{10}$) at step 1017, the routine executes steps 1017 and 1019 which determines whether the value (FAF+KG) is larger than a predetermined upper limit value $B_{MAX}$, or smaller than a predetermined lower limit value $B_{MIN}$. If the value (FAF+KG) is larger than the upper limit value $B_{MAX}$ or lower than the lower limit value $B_{MIN}$, i.e. If the value (FAF+KG) is excessively large or small, it is considered that the fuel supply system has failed. In this case, a failure flag XAB is set to 1 at step 1027, When the value of the failure flag XAB is set to 1 by the routine in FIG. 10, an alarm is activated by another routine (not shown) to inform the driver that a failure has occurred in the fuel supply system. The value of a failure flag XAB is stored in the backup RAM 34 to facilitate future inspection and maintenance.

On the other hand, if the value (FAF+KG) is within the range between the upper limit value $B_{MAX}$ and the lower limit value $B_{MIN}$ at steps 1019 and 1021, since it is considered that there is no failure in the fuel supply system, the value of the flag $X_1$ is set to 1 at step 1023, and the value of the counter $C_2$ is set to 0 at step 1025.

Once the failure detection at steps 1019 through 1027 is performed, the fuel vapor supply from the canister 19 is restarted (the solenoid valve 26 is opened) at step 1029, and the value of the flag $X_1$ is reset to 1 at step 1031.

Since the value of the flag $X_2$ is set to 1 at step 1023 once the failure detection is carried out, the routine terminates immediately after step 1001 when the routine is processed next. Therefore, the failure detection is not carried out until the value of the counter $C_2$ increases to $C_{20}$ and, thereby the value of the flag is set to 0 in FIG. 9.

As explained above, according to the present invention, a failure of the fuel supply system in which fuel injection amount decreases, as well as the failure in which the fuel injection amount increases, can be detected. Further, since the separate correction factors (FGPG and KG) are used in accordance with whether the fuel vapor is supplied to the engine, the controllable air-fuel ratio range does not become narrow even when the failure detection is performed.

I claim:

1. A failure detecting device for a fuel supply system of an internal combustion engine, comprising:

fuel vapor supply means for supplying and stopping fuel vapor from a fuel supply system to an intake air passage of an engine;

an air-fuel ratio sensor disposed in an exhaust gas passage of the engine for detecting an air-fuel ratio of an exhaust gas from the engine;

feedback control means for setting a value of an air-fuel ratio feedback correction factor in accordance with the air-fuel ratio of the exhaust gas detected by the air-fuel ratio sensor in such a manner that the air-fuel ratio of the exhaust gas becomes a stoichiometric air-fuel ratio;

feedback learning correction means for setting a value of a feedback learning correction factor when the fuel vapor is not supplied to the intake air passage in such a manner that the center value of the fluctuation of the air-fuel ratio feedback correction factor agrees with a predetermined reference value;

fuel vapor learning correction means for setting a value of a fuel vapor learning correction factor when the fuel vapor is supplied to the intake air passage in such a manner that the center value of the fluctuation of the air-fuel ratio feedback correction factor agrees with said reference value;

first air-fuel ratio correction means for setting a value of a first air-fuel ratio correction factor in accordance with the air-fuel ratio feedback correction factor and the feedback learning correction factor;

second air-fuel ratio correction means for setting a value of a second air-fuel ratio correction factor in accordance with the air-fuel ratio feedback correction factor and the feedback learning correction factor and the fuel vapor learning correction factor;

fuel supply control means for controlling the amount of fuel supplied to the engine in accordance with the first air-fuel ratio correction factor when the fuel vapor is not supplied to the intake air passage, and in accordance with the second air-fuel ratio correction factor when the fuel vapor is supplied to the intake air passage by the fuel vapor supply means;

determining means for determining whether the value of the first air-fuel ratio correction factor is within a predetermined range when the fuel vapor supply means is supplying fuel vapor to the intake air passage; and failure detecting means for stopping the fuel vapor supply means from supplying the fuel vapor to the intake air passage when the determining means determines that the value of the air-fuel ratio correction factor is larger than or smaller than said predetermined range, and after stopping the fuel vapor supply means, determining that the fuel supply system has failed if the value of the air-fuel ratio correction factor is larger than a predetermined upper limit value or lower than a predetermined lower limit value.

2. A failure detecting device for a fuel supply system of an internal combustion engine, comprising:

a fuel vapor supply device for supplying and stopping fuel vapor from a fuel supply system to an intake air passage of an engine;

an air-fuel ratio sensor disposed in an exhaust gas passage of the engine for detecting air-fuel ratio of an exhaust gas from the engine;

an electronic control unit receiving an output signal from the air-fuel ratio sensor, and performing the functions of:

a) calculating an air-fuel ratio feedback correction factor in accordance with the output signal from the air-fuel ratio sensor in such a manner that the output signal from the air-fuel ratio sensor becomes an output corresponding to a stoichiometric air-fuel ratio;

b) calculating a feedback learning correction factor when the fuel vapor supply device is not supplying fuel vapor to the intake air passage in such a manner that the center value of the fluctuation of the air-fuel ratio feedback correction factor agrees with a predetermined reference value;

c) calculating a fuel vapor learning correction factor when the fuel vapor supply device is supplying fuel vapor to the intake air passage in such a manner that the center value of the fluctuation of the air-fuel ratio feedback correction factor agrees with said reference value;

d) calculating a first air-fuel ratio correction factor in accordance with the air-fuel ratio feedback correction factor and the feedback learning correction factor;

e) calculating a second air-fuel ratio correction factor in accordance with the air-fuel ratio feedback correction factor and the feedback learning correction factor and the fuel vapor learning correction factor;

f) controlling the amount of fuel supplied to the engine in accordance with the first air-fuel ratio correction factor when the fuel vapor supply device is not supplying fuel vapor to the intake air passage, and in accordance with the second air-fuel ratio correction factor when the fuel vapor supply device is supplying fuel vapor to the intake air passage;

g) determining whether the value of the first air-fuel ratio correction factor is within a predetermined range when the fuel vapor supply device is supplying fuel vapor to the intake air passage; and h) stopping the fuel vapor supply device from supplying fuel vapor to the intake air passage when it is determined that the value of the air-fuel ratio correction factor is larger than or smaller than said predetermined range, and determining that the fuel supply system has failed if the value of the air-fuel ratio correction factor is larger than a predetermined upper limit value or lower than a predetermined lower limit value after the fuel vapor supply has been stopped.

3. A method for detecting failure in a fuel supply system of an internal combustion engine comprising steps of;

a) supplying and stopping fuel vapor from a fuel supply system to an intake air passage of an internal combustion engine;

b) detecting an air-fuel ratio of an exhaust gas from the engine;

c) setting an air-fuel ratio feedback correction factor in accordance with the air-fuel ratio of the exhaust gas in such a manner that the air-fuel ratio of the exhaust gas becomes a stoichiometric air-fuel ratio;

d) setting a feedback learning correction factor when the fuel vapor is not supplied to the intake air passage in such a manner that the center value of the fluctuation of the air-fuel ratio feedback correction factor agrees with a predetermined reference value;

e) setting a fuel vapor learning correction factor when the fuel vapor is supplied to the intake air passage in such a manner that the center value of the fluctuation of the air-fuel ratio feedback correction factor agrees with said reference value;

f) setting a first air-fuel ratio correction factor in accordance with the air-fuel ratio feedback correction factor and the feedback learning correction factor;

g) setting a second air-fuel ratio correction factor in accordance with the air-fuel ratio feedback correction factor and the feedback learning correction factor and the fuel vapor learning correction factor;

h) controlling the amount of fuel supplied to the engine in accordance with the first air-fuel ratio correction factor when the fuel vapor is not supplied to the intake air passage, and in accordance with the second air-fuel ratio correction factor when the fuel vapor is supplied to the intake air passage;

i) determining whether the value of the first air-fuel ratio correction factor is within a predetermined range when the fuel vapor is supplied to the intake air passage; and j) stopping the fuel vapor supply to the intake air passage when it is determined that the value of the air-fuel ratio correction factor is larger than or smaller than said predetermined range, and determining that the fuel supply system has failed if the value of the air-fuel ratio correction factor is larger than a predetermined upper limit value or lower than a predetermined lower limit value after the fuel vapor supply has been stopped.

* * * * *